US005826532A

United States Patent [19]

Elvestad

[11] Patent Number: 5,826,532

[45] Date of Patent: Oct. 27, 1998

[54] BOAT SEAT

[76] Inventor: Alf J. Elvestad, P.O. Box 700, Enfield, N.H. 03748

[21] Appl. No.: 624,948

[22] Filed: Mar. 29, 1996

[51] Int. Cl.[6] ..... B63B 35/00

[52] U.S. Cl. ..... 114/347; 114/363

[58] Field of Search ..... 114/363, 347; 297/14, 331, 334, 338, 335, 297, 296

[56] References Cited

U.S. PATENT DOCUMENTS

| | | | |
|---|---|---|---|
| 3,163,409 | 12/1964 | Running et al. | 114/363 |
| 4,357,894 | 11/1982 | Kirk | 114/363 |
| 4,926,783 | 5/1990 | Lathers | 114/343 |
| 5,257,590 | 11/1993 | Foote, Jr. et al. | 114/347 |
| 5,320,060 | 6/1994 | Gunter | 114/363 |

OTHER PUBLICATIONS

Wildwater Designs Catalog, 1994, pp. 14 and 23.
Voyageur Catalog, 1995, pp. 16 and 17.

*Primary Examiner*—Stephen Avila

*Attorney, Agent, or Firm*—Michael J. Weins

[57] ABSTRACT

The present invention is a boat seat having particular utility in canoes. The seat has a platform connected to a brace having a brace first end region connected to the boat, and a brace second end region supported on the shell of the boat via a load-distributing member such as a pad or cross support. Preferably the platform is pivotably mounted to the brace so that the platform can be maintained in a horizontal position or in an inclined position. For traditional canoes the brace first end region is attached to one of the thwarts of the canoe. For collapsible canoes which have a skin supported by stringers which in turn are supported by ribs, a brace support is also employed. The brace support and the brace are in turn supported by a base. The base is formed by a cross support resting across several stringers to distribute loads, a retaining element connecting to the cross support and to a rib of the canoe, and the rib to which the retaining element attaches. In one preferred embodiment the seat will collapse into a nested series of elements.

37 Claims, 7 Drawing Sheets

BOAT SEAT

This application takes priority from Provisional Patent Application 60/002,342 filed Aug. 15, 1995.

1. Field of Invention

The present invention is for a boat seat and particularly for a seat having particular utility for canoes.

2. Background of Invention

Seats for canoes have traditionally spanned the full width of the canoe and have been attached to the gunwales of the canoe. These seats are comfortable for sitting, but result in a relatively high center of gravity, reducing stability. To improve stability and control of the canoe, canoeists frequently kneel. Moving from a sitting position to a kneeling position requires a substantial effort, since the legs must be tucked under the seat. In the kneeling position, the canoeist rests on the edge of the seat and this position can cause discomfort; additionally, having legs under the seat can cause a risk of entrapment if the canoe capsizes.

Pedestal seats, disclosed in U.S. Pat. Nos. 5,257,590 and 5,320,060, have in part overcome the problem of discomfort in the kneeling position; however, they do not provide for an alternate sitting position. Also, pedestal seats are not well suited for collapsible canoes, since attachment of the seat to the canoe can be difficult and the seat itself is a bulky unit to transport.

OBJECTS OF THE INVENTION

It is an object of the invention to provide a boat seat which spans less than the beam of the boat.

It is another object of the invention to provide a boat seat which allows the operator to position his/her legs either in an extended forward position, or in a bent position with his/her legs tucked underneath.

It is still another object of the invention to provide an adjustable canoe seat having a platform for support of the operator which can be inclined to give the user a lower center of gravity, as he/she is in a kneeling position, or can be raised to a horizontal position with respect to the gunwales, to provide a sitting position.

It is yet another object of the invention to provide a boat seat suitable for use in a collapsible canoe.

It is a further object of the invention to provide a boat seat which is collapsible.

It is a yet a further object of the invention to provide a seat which can provide limited motion between the boat and the seat.

It is still a further object of the invention to provide a canoe seat which allows the operator's legs to readily disengage from the canoe in the event the canoe capsizes.

Yet a further object of this invention is to provide a seat where the bow to aft position of the seat can be changed.

These and other objects of the invention will be apparent from the following description, associated figures and claims.

SUMMARY OF THE INVENTION

The present invention is a seat which supports an operator of a hand paddle-powered boat having a shell. The seat, in its elementary form, has a platform for support of the operator coupled to a brace. The platform and the brace can be an integral unit. The brace has a brace first end region and a brace second end region. The brace first end region is connected to the boat, while the brace second end region is supported on the shell of the boat. It is preferred to employ means to movably engage the brace first end region to connect it to the boat, and it is further preferred for the means to provide a pivoting motion.

When the seat is employed in a rigid shell canoe having a beam defined by the separation of its gunwales, which are stabilized by thwarts, a connector attached to one of the thwarts is attached to the brace first end region. The connector serves to connect the brace first end region to the boat, and preferably provides limited rotational, translational, or combined motion therebetween.

The support for the brace second end region on the shell of the boat will depend in part on the type of boat into which the seat is to be installed. In all cases, the load on the shell from the brace second end region must be distributed to avoid damage to the shell. For rigid shell boats the shell itself may have sufficient strength to distribute the load. Preferably, a pad is interposed between the shell and the brace second end region to distribute the load from the brace second end region on the shell. It is further preferred that the pad be attached to the shell or to the brace second end region. The pad can be an integral part of the brace second end region.

For collapsible boats which have a flexible skin supported by stringers, the skin frequently will not have sufficient strength to support the load from the brace second end region. In such cases, it is preferred that a cross support be interposed across the stringers of the boat and connected to the brace second end region. The cross support can be an integral part of the brace second end region or, alternatively, the cross support can be a separate member. When a separate cross support is employed, the brace second end region is preferably provided with at least one brace clamp configured to engage the cross support.

In both rigid shell and collapsible canoes, it is further preferred that the platform be pivotably mounted with respect to the brace and that means be provided for maintaining the platform in a substantially horizontal position, approximately parallel with the gunwales of the canoe, and an inclined position, where the platform is inclined with respect to the gunwales. The substantially horizontal position is well suited for recreational paddling by the operator or canoeist; while the inclined position, which allows the canoeist to lower his/her center of gravity, is well suited for more aggressive paddling where greater stability is desired.

When the platform is pivotably attached to the brace, a prop having a prop first end region and a prop second end region serves as means for maintaining the platform in the substantially horizontal position and the inclined position. The prop is rotatably mounted with respect to the platform and the brace and rotation of the prop affects the position of the platform. The prop is rotatable between an upper position, where the prop engages the platform and the brace such that the platform is maintained substantially parallel to the gunwales, and a lower position, where the prop engages the platform and the brace such that the platform is maintained inclined with respect to the gunwales.

In one preferred embodiment, the prop first end region is pivotably attached to the platform and the prop second end region can be moved between an upper prop engaging site associated with the brace and a lower prop engaging site associated with the brace. The prop engaging sites are so located that when the upper prop engaging site is engaged by the prop, the platform will be substantially horizontal, and when the lower prop engaging site is engaged, the platform will be inclined with respect to the gunwales. While it is preferred to have the prop first end region pivotably attached to the platform and the prop engaging sites located on the brace for ease of operation, it should be appreciated that the prop second end region could be pivotably attached to the brace and the prop engaging sites located on the platform for engaging the prop first end region, in which case, while the prop engaging sites reside on the platform, they are still associated with the brace via the geometry of the brace, the prop, and the location of the sites on the platform.

In an alternative embodiment, the means for maintaining the platform in a substantially horizontal position and an inclined position with respect to the gunwales is at least one crank which is employed in combination with the prop. The crank is pivotably attached to the prop second end region and pivotably attached to the brace. When a crank is employed, the upper and lower prop engaging sites may be on the brace or, alternatively, may be defined by an angular location of the crank with respect to the brace, in which case they are defined with respect to the brace by polar coordinates.

A preferred brace configuration for the seat of the present invention has a first brace rail having a first brace rail first end region, which forms part of the brace first end region, and a first brace rail second end region, which forms part of the brace second end region. A second brace rail is also provided which has a second brace rail first end region, which forms part of the brace first end region, and a second brace rail second end region, which forms part of the brace second end region. The first brace rail is attached to the connector, which in turn is attached to the thwart. Similarly, the second brace rail is connected to the thwart by the connector. It should be appreciated that the connector could be formed by a first bracket and a second bracket which connect the brace rails to the thwart. The connector preferably provides a pivotable connection between the thwart and the brace rails.

Means are provided to maintain the first brace rail and the second brace rail in a spaced apart relationship. In one preferred embodiment, the spaced apart relationship is maintained by a first rung which engages the first brace rail and the second brace rail, and is located in the second brace end region. A second rung, spaced apart from the first rung, is positioned such that the first rung lies between the platform and the second rung. It is further preferred that when the rungs are employed, the first rung also serves as the upper prop engaging site, and the second rung serves as the lower prop engaging site.

In a preferred prop configuration, the prop has a first prop post and a second prop post, each of the prop posts having a prop post first end. The prop post first ends collectively form the prop first end region and are pivotably attached to the platform. Similarly, each of the prop posts has a prop post second end terminating in a prop clamp, the prop post second ends collectively forming the prop second end region. The prop clamps are designed to engage the rungs of the brace.

For collapsible canoes having a shell which consists of a flexible skin over stringers, which in turn are supported by ribs which are tied in to gunwales that are stabilized by thwarts, a cross support is employed to distribute the load from the brace second end region across multiple stringers. A retaining element is provided which attaches to the cross support and to one of the ribs of the canoe. In combination, the rib, the retaining element, and the cross support form a base for support of the brace.

For such collapsible canoes, it is preferred that the brace first end region be connected to the canoe via a brace support having a brace support first end region and a brace support second end region. The brace support first end region is preferably pivotably mounted with respect to the brace. The brace support first end region can be pivotably attached directly to the brace first end region or, alternatively, can be mounted to the platform to which the brace is also pivotably mounted.

It is further preferred that at least one brace support clamp be provided, attached to the brace support second end region. The at least one brace support clamp can be connected to a rib of the canoe, and serves to connect the brace support to the base. In this case, the at least one brace clamp engages the cross support.

Alternatively, the at least one brace support clamp may engage the cross support, and the cross support in turn connects to a rib of the canoe by the retaining element. The retaining element and the cross support can be an integral unit. It should be appreciated that when the at least one brace support clamp engages the cross support, the at least one brace clamp engages the rib of the canoe.

It is preferred that the cross support be fitted with means to sideways engage at least one stringer of the collapsible canoe, to further stabilize the brace and maintain it centered with respect to the bottom of the canoe.

It is further preferred that the brace, prop, and brace support be configured so as to nest when the seat is collapsed.

For a light weight brace support, it is preferred that the brace support be fabricated from tube stock into a U-shaped brace support. The U-shaped brace support has a brace support closed end region, which forms the brace support first end region, and a brace support open end region, which serves as the brace support second end region. The brace support open end region of the U-shaped structure forms two legs. These legs provide a first support post and a second support post. The brace support first end region is pivotably mounted with respect to the brace. The first and second support posts of the brace support second end region are spaced apart at an inner separation S1, which is defined as the minimum separation between the first support post and the second support post, and an outer separation S2, which is defined as the maximum separation between the first support post and the second support post. The support posts have free ends which terminate in support clamps designed to be engaged to a rib of the canoe, or to the cross support if such be provided.

When the brace is fabricated from tube stock, it is also preferably U-shaped, having a brace closed end region, which serves as the brace first end region, and a brace open end region, which serves as a brace second end region. Legs of the U-shaped brace serve as the first brace rail and the second brace rail. The brace rails are spaced apart, having an inner separation S3 and an outer separation S4, where the inner separation and the outer separation refer to the minimum and the maximum separation, respectively, between the first brace rail and the second brace rail. A first rung is attached between the first brace rail and the second brace rail and serves as the upper prop engaging site. The cross support can provide the lower prop engaging site, or a second rung can be provided.

Similarly, when the prop is fabricated from tube stock, it is preferred that the prop is U-shaped, having a closed end, which is the first prop end region, and an open end, which is the second prop end region and provides a first prop post and a second prop post. The prop posts are spaced apart, having an inner separation S5 and an outer separation S6, where again the separation refers to the minimum and the maximum separation, respectively, between the prop posts.

It is further preferred that the U-shaped brace support, brace, and prop have their dimensions adjusted such that S6<S3 and S4<S1, to assure that the elements will nest when the seat is collapsed. When the first rung is attached to the first brace rail and the second brace rail, the first rung preferably should be spaced apart from the brace closed end at a distance sufficient to accommodate the prop posts when the elements are nested.

It is also preferred that tie-downs be provided which maintain the cross support in close proximity to the stringers on which it rests.

BRIEF DESCRIPTION OF THE FIGURES

FIG. 6 illustrates the seat in the position where the platform is substantially parallel to the gunwales. FIG. 7 illustrates the seat where the platform is inclined with respect to the gunwales.

FIG. 9 illustrates the seat when the platform is positioned substantially parallel to the gunwales. FIG. 10 illustrates the seat where the platform is inclined with respect to the gunwales.

BEST MODE OF CARRYING THE INVENTION INTO PRACTICE

Figure 1:
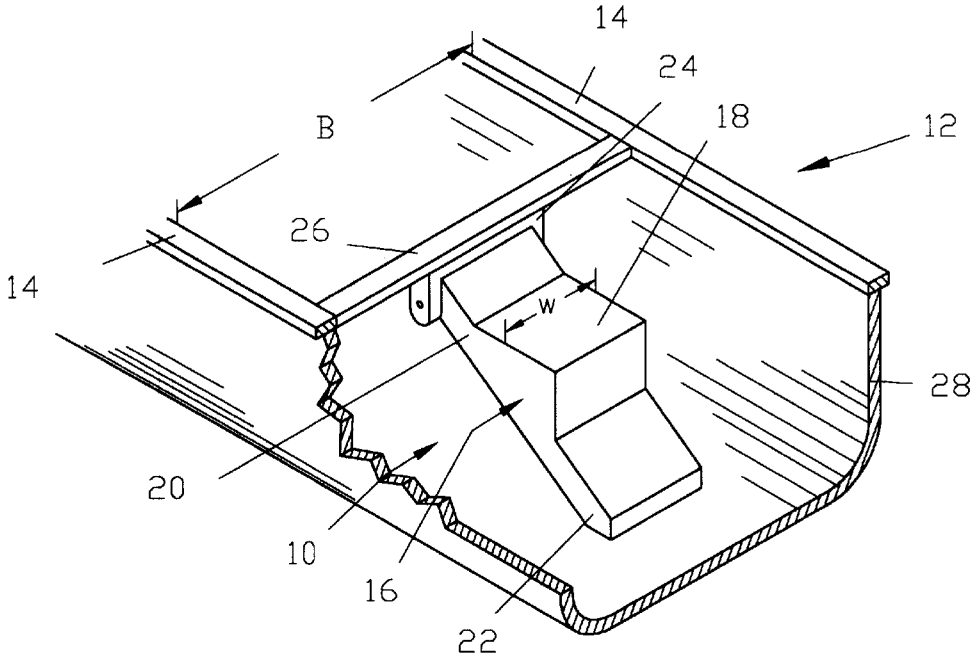
FIG. 1 is an isometric view of one embodiment of the seat of the present invention, which is designed for use in a conventional rigid shell canoe having gunwales which are stabilized by thwarts. The seat has a platform which is an integral part of a brace. A brace first end region is attached to one of the thwarts with a connector, and a brace second end region is supported on the bottom of the canoe.

FIG. 1 illustrates a seat 10 of one embodiment of the present invention. The seat 10, as illustrated, is installed in a conventional canoe 12 and resides between gunwales 14. The seat 10 has a width W which is less than beam B of the canoe 12, and it is preferred that the width W is sufficiently narrow to allow the legs of the canoeist to pass between the seat 10 and the gunwales 14.

The seat 10 has a brace 16 and a platform 18, which are formed as an integral unit. The brace 16 has a brace first end region 20 and a brace second end region 22. A connector 24, which is affixed to a thwart 26 which spans the gunwales 14 of the canoe 12, engages the brace first end region 20 of the brace 16, connecting the brace 16 to the thwart 26. The connector 24 preferably allows limited motion between the brace 16 and the thwart 26. It is further preferred that this limited motion be rotational, since a small angular displacement will provide substantial adjustment in the position of the brace second end region 22 with respect to a shell 28 of the canoe 12. If the brace first end 20 is fixably connected with respect to the thwart 26, the brace 16 should be sufficiently flexible to provide for limited motion between the brace second end region 22 and the shell 28. It should also be appreciated that the thwart 26 and the connector 24 could be formed as an integral unit.

The shell 28 of the canoe 12 supports the brace second end region 22. The brace 16 can be directly supported by the shell 28, and when so supported will provide limited translational motion between the brace second end region 22 and the canoe 12 to accommodate any flexing of the shell 28.

Figure 2:
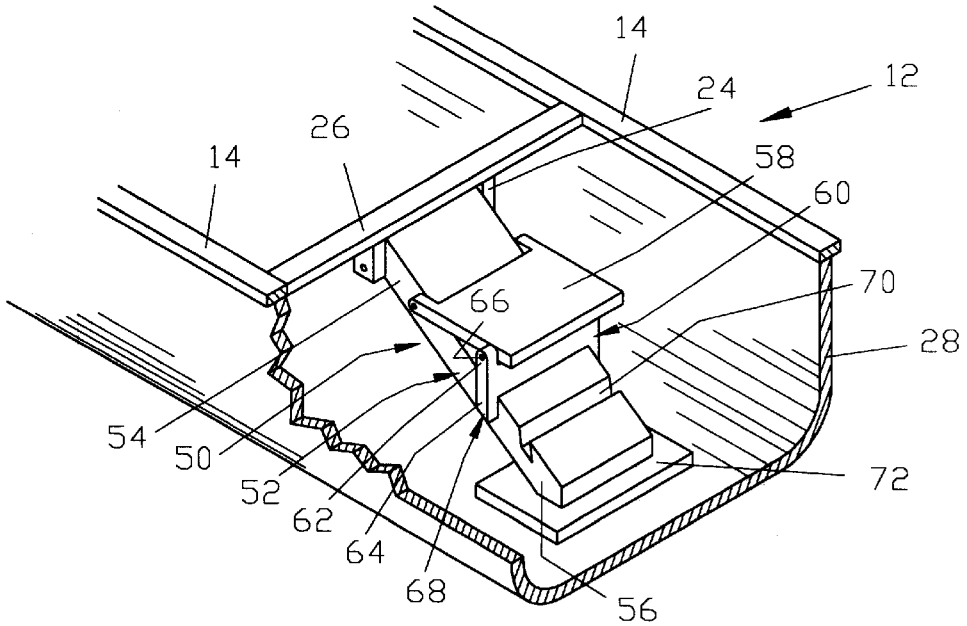
FIG. 2 is an isometric view of another embodiment of the seat of the present invention. In this embodiment, the seat is again designed for use in a rigid shell canoe. A brace is again secured to the thwart by a connector, which is pivotably attached to the brace, and a platform in turn is pivotably mounted to the brace. The brace has a pad interposed between the brace second end region and the shell of the canoe. A prop is pivotably mounted to the platform and, as shown, is engaged in a first brace slot. When so positioned, the prop maintains the platform substantially parallel to the gunwales of the canoe. The brace also has a second brace slot which, when engaged by the prop, maintains the platform inclined with respect to the gunwales.

FIG. 2 illustrates a seat 50 which is another embodiment of the present invention which is suitable for use in a conventional canoe 12. The seat 50 has a brace 52 which has a brace first end region 54 and a brace second end region 56. A platform 58 is pivotably attached to the brace 52. A prop 60, having a prop first end region 62 and a prop second end region 64, is pivotably attached to the platform 58. Prop pins 66 (only one of which is shown in FIG. 2) connect the prop first end region 62 to the platform 58. The prop 60 can be rotated between an upper prop position, where the prop second end region 64 engages a first brace slot 68 on the brace 52 which serves as an upper prop engaging site, and a lower prop position, where the prop second end region 64 engages a second brace slot 70 on the brace 52 which serves as a lower prop engaging site.

When the prop 60 is engaged in the upper prop engaging site, the platform 58 will be substantially parallel to the gunwales 14, and when the lower prop engaging site is engaged by the prop 60, the platform 58 will be inclined with respect to the gunwales 14.

In this embodiment, as with the embodiment illustrated in FIG. 1, the connector 24 is preferably pivotably connected to the brace first end region 54 and connected to the thwart 26. The connector 24 and the thwart 26 support the brace first end region 54. A pad 72 is interposed between the shell 28 of the canoe 12 and the brace second end region 56. The pad 72 is preferably affixed to either the brace 52 or the shell 28. The pad 72 is employed to distribute the load from the brace 52 onto the shell 28 by supporting the brace second end region 56.

While FIG. 2 depicts the prop 60 as pivotably engaged with the platform 58 and the brace 52 as having brace slots (68 and 70), it should be appreciated that prop 60 could pivot about the brace 52 and the slots (68 and 70) could be provided in the platform 58. However, the configuration illustrated in FIG. 2 is preferred, since its operation is simplified by allowing gravity to assist in the movement of the prop 60 from the first brace slot 68 to the second brace slot 70.

Figure 3:
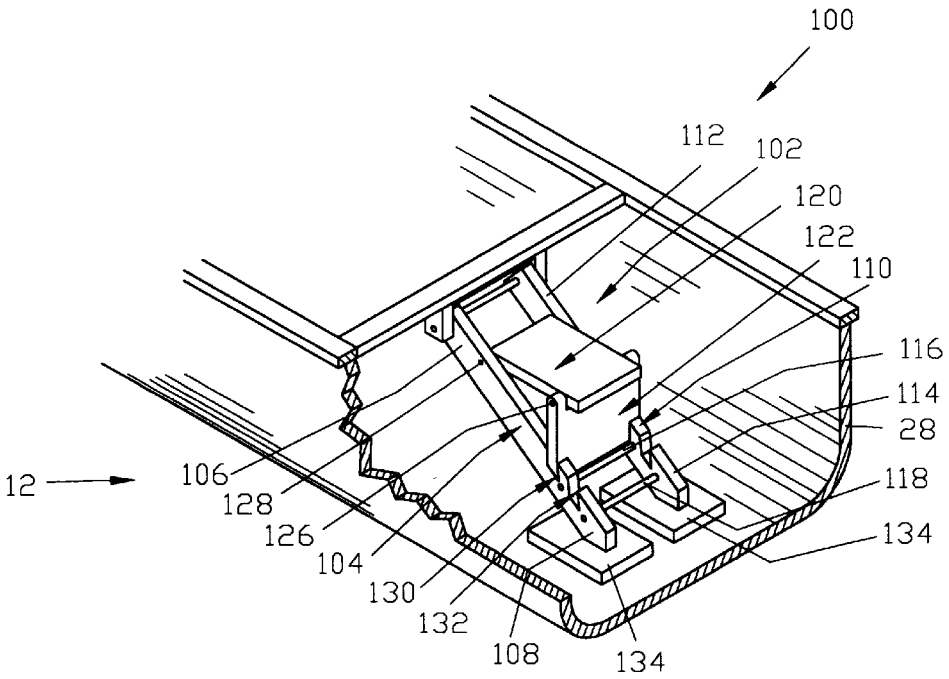
FIG. 3 is an isometric view of another embodiment of the seat of the present invention and is similar to the embodiment of FIG. 2. In this embodiment, the brace is a multi-element member, having two spaced apart brace rails which have a first rung and a second rung mounted therebetween. The brace rails in turn are attached to one of the thwarts of the canoe by a pivotable connector. A platform is pivotably attached to the spaced apart brace rails, and a prop, which is pivotably attached to the platform, is engaged in a first set of brace notches to hold the platform substantially parallel to the gunwales of the canoe. A second set of brace notches is provided which, when engaged by the prop, maintains the platform inclined with respect to the gunwales.

FIG. 3 illustrates a seat 100 which is another embodiment of the present invention, and is similar to the seat 50 shown in FIG. 2. The seat 100 has a brace 102 with a different structure than the brace 52 of the seat 50. The brace 102 has a first brace rail 104, with a first brace rail first end region 106 and a first brace rail second end region 108. The brace 102 also has a second brace rail 110, having a second brace rail first end region 112 and a second brace rail second end region 114. The first brace rail first end region 106 and the second brace rail first end region 112 collectively form the brace first end region, while the first brace rail second end region 108 and the second brace rail second end region 114 collectively form the brace second end region. A first rung 116 and a second rung 118 are employed to maintain the first brace rail 104 in a spaced apart relationship to the second brace rail 110.

A platform 120 is pivotably engaged with the first brace rail first end region 106 and with the second brace rail first end region 112. A prop 122 is pivotably connected to the platform 120 with prop pins 126 (only one of which is shown in FIG. 3). The platform 120 in turn is pivotably attached to the first brace rail 104 and the second brace rail 110 with platform pins 128 (only one of which is shown in FIG. 3). A first set of brace notches 130 on the brace rails (104 and 110) serves as the upper prop engaging site for the prop 122, and a second set of brace notches 132 on the brace rails (104 and 110) serves as the lower prop engaging site for the prop 122. In this embodiment, two support pads 134 are attached to the brace rail second end regions (108 and 114) to distribute the load on the shell 28 of the canoe 12 in which the seat 100 is mounted.

Figure 4:
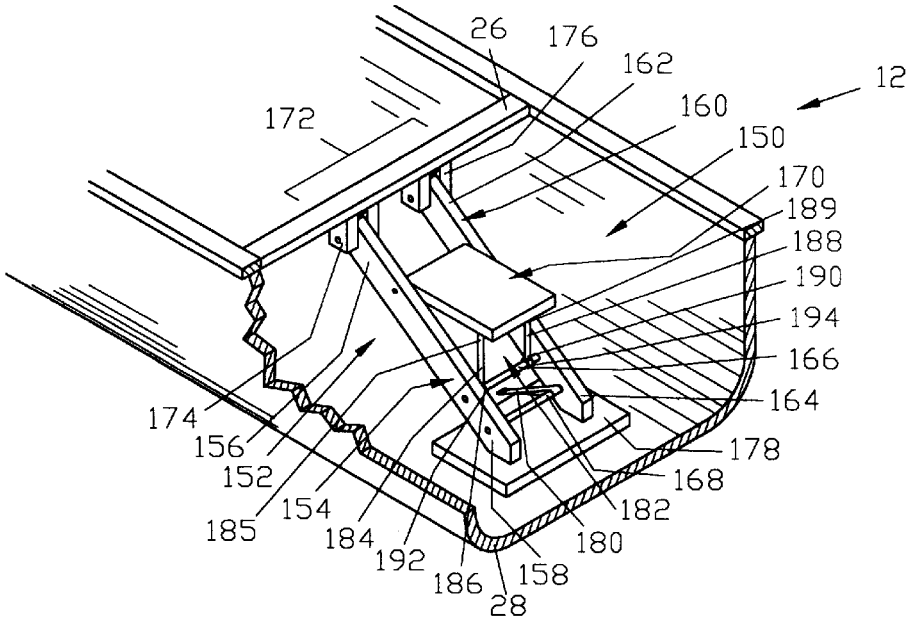
FIG. 4 is an isometric view of another embodiment of the seat of the present invention, and shares many elements in common with the embodiment of FIG. 3. The seat has a brace with a pair of brace rails, which are individually connected to a thwart by a first bracket and a second bracket which form the connector. The seat of the embodiment of FIG. 4 has a prop with a first prop post and a second prop post which are pivotably mounted to the platform. These prop posts have free ends which terminate with prop clamps. The prop clamps can be engaged with either a first rung or a second rung of the brace. Moving the prop clamps from the first rung to the second rung changes the inclination of the platform on which the operator rests with respect to the gunwales of the canoe. A tie down is attached to one of the rungs and in turn attaches to the shell of the boat to further stabilize the brace.

FIG. 4 illustrates a seat 150 of another embodiment of the present invention, which is similar to the seat 100 of FIG. 3. Again, the seat 150 has a brace 152 having a first brace rail 154, with a first brace rail first end region 156 and a first brace rail second end region 158, and a second brace rail 160, with a second brace rail first end region 162 and a second race rail second end region 164. The brace rails (154 and 160) are maintained in a spaced apart relationship by a first rung 166 and a second rung 168.

A platform 170 is pivotably engaged with the first brace rail 154 and the second brace rail 160. The rungs (166 and 168) are positioned such that the first rung 166 lies between the second rung 168 and the platform 170.

A connector 172 consists of a first bracket 174, which pivotably engages the first brace rail first end region 156, and a second bracket 176, which pivotably engages the second brace rail first end region 162. The first bracket 174 and the second bracket 176 are in turn attached to the thwart 26.

The brace 152 rests on a pad 178 which allows relative movement between the brace rail second end regions (158 and 164) and the shell 28 of the canoe 12. In this embodiment, an elastic strap 180 serves as an expandable coupling, and is attached to the brace 152 and the canoe 12. The elastic strap 180 limits the motion between the brace rail second end regions (158 and 164) and the pad 178.

A prop 182 is employed, which has a first prop post 184, having a first prop post first end 185 and a first prop post second end 186, and a second prop post 188, having a second prop post first end 189 and a second prop post second end 190. The first prop post first end 185 and the second prop post first end 189 collectively provide the prop first end region, while the first prop post second end 186 and the second prop post second end 190 collectively provide the prop second end region. The first prop post first end 189 is pivotably attached to the platform 170, and the first prop post second end 186 is fitted with a first rung-engaging clip 192 configured to be engageable with the first rung 166 and the second rung 168. Similarly, the second prop post first end 189 is pivotably attached to the platform 170, and the second prop post second end 190 is fitted with a second rung-engaging clip 194, also configured to be engageable with the first rung 166 and the second rung 168.

In the embodiment shown in FIG. 4 the first rung 166 and the second rung 168 serve, respectively, as the upper prop engaging site and the lower prop engaging site.

Figure 5:
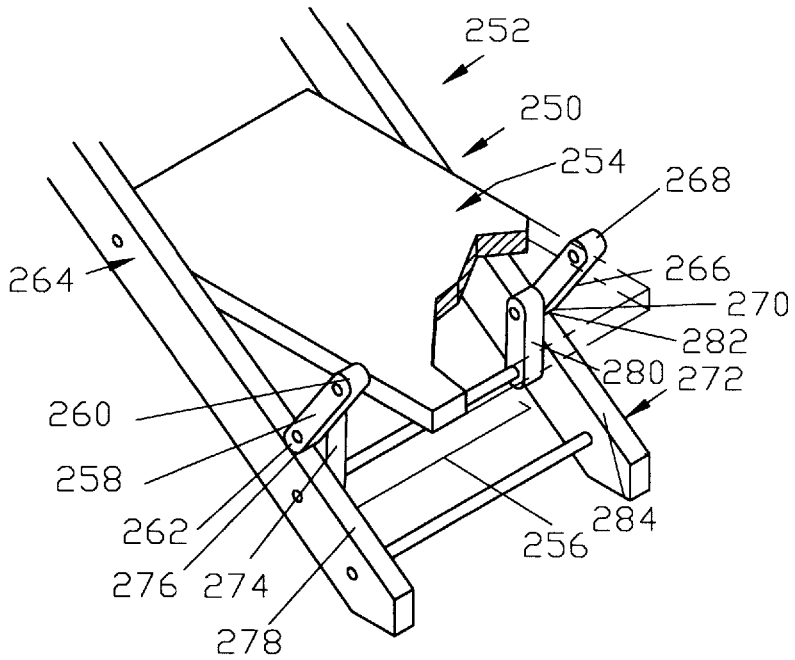
FIG. 5 is an isometric view of a seat of another embodiment of the present invention. The seat has a brace with a platform pivotably mounted thereto. Cranks are employed, which are pivotably connected to brace rails of the brace, and to prop posts which support the platform. The cranks direct the prop posts to alternate locations on the brace, thereby providing for adjustment of the platform to the horizontal position or the inclined position with respect to the gunwales.

FIG. 5 shows a seat 250 which is another embodiment of the present invention. The seat 250 has a brace 252 similar to the brace 152 of the seat 150, and also has a platform 254 similar to the platform 170 of the seat 150. The seat 250 has a prop 256 which differs from the prop 182 of the embodiment of FIG. 4. The prop 256 has a first prop post 258, having a first prop post first end 260 and a first prop post second end 262. The first prop post first end 260 is pivotably attached to the platform 254 such that the first prop post second end 262 will swingably engage a first brace rail 264 of the brace 252. The prop 256 also has a second prop post 266, having a second prop post first end 268 and a second prop post second end 270. The second prop post first end 268 is pivotably attached to the platform 254 such that the second prop post second end 270 will swingably engage a second brace rail 272 of the brace 252. Again, the first prop post first end 260 and the second prop post first end 268 collectively serve as the prop first end region, while the first prop post second end 262 and the second prop post second end 270 collectively serve as the prop second end region.

A first crank 274 is pivotably mounted to the first brace rail 264 and to the first prop post second end 262, guiding the first prop post second end 262 between a first rail upper engaging site 276, where the first prop post second end 262 is in contact with the first brace rail 264, and a first rail lower engaging site 278, where the first prop post second end 262 is again in contact with the first brace rail 264.

A second crank 280 is pivotably mounted to the second brace rail 272 and to the second prop post second end 270, guiding the second prop post second end 270 between a second rail upper engaging site 282, where the second prop post second end 270 is in contact with the second brace rail 272, and a second rail lower engaging site 284, where the second prop post second end 270 is in contact with the second brace rail 272.

Figure 6:
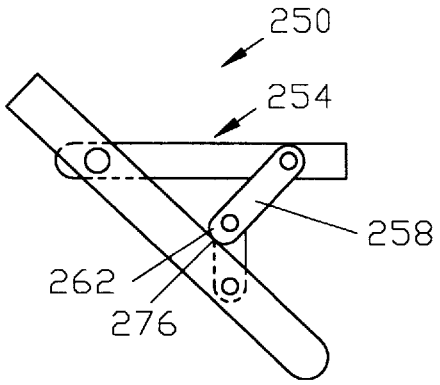
FIGS. 6 and 7 are side views of the embodiment of FIG. 5.

FIG. 6 is a side view of the seat 250 of FIG. 5 and shows the platform 254 in the horizontal position, where the first prop post 258 is positioned such that the first prop post second end 262 is at the first rail upper engaging site 276.

Figure 7:
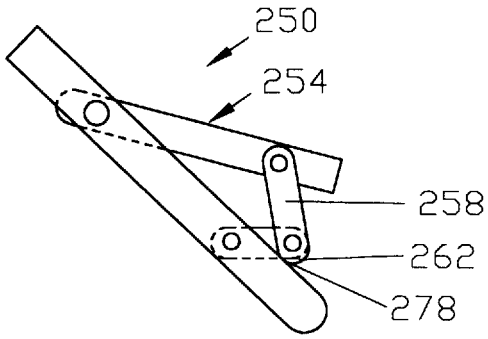

FIG. 7 is the same side view as FIG. 6 and shows the platform 254 inclined with respect to the gunwales, and shows the first prop post second end 262 in contact with the first rail lower engaging site 278.

Figure 8:
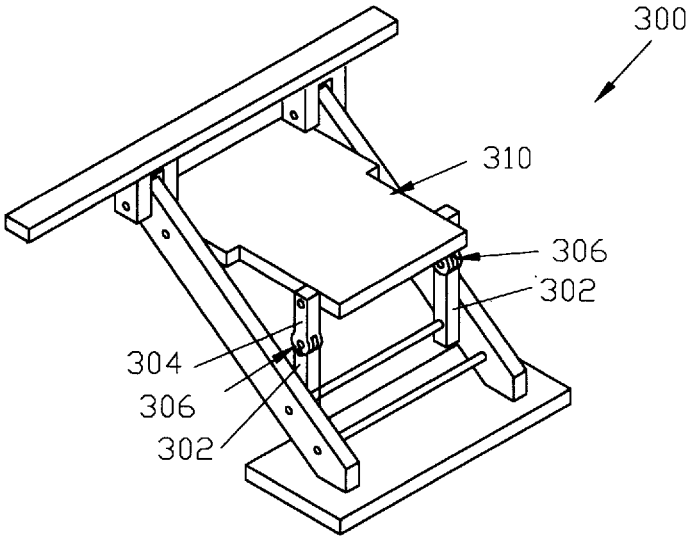
FIG. 8 is an isometric view of another embodiment of the seat of the present invention which is similar to the embodiment of FIG. 5. This embodiment employs a brace, a platform, a prop having prop posts, and cranks which are attached to the prop posts. The seat of FIG. 8 differs from the seat of FIG. 5 in that lockable pivotable connectors, which connect the cranks to the prop posts, are employed. These lockable pivotable connectors provide for alternate positions of the platform with respect to the gunwales of the canoe.
Figure 9:
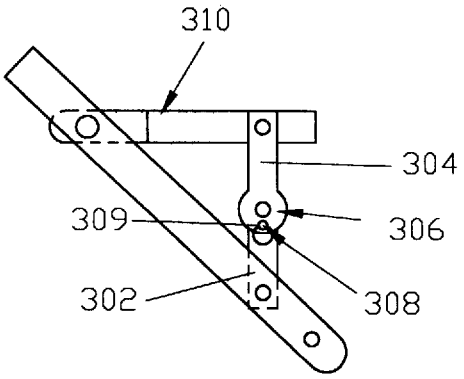
FIGS. 9 and 10 are side views of the seat of FIG. 6.
Figure 10:
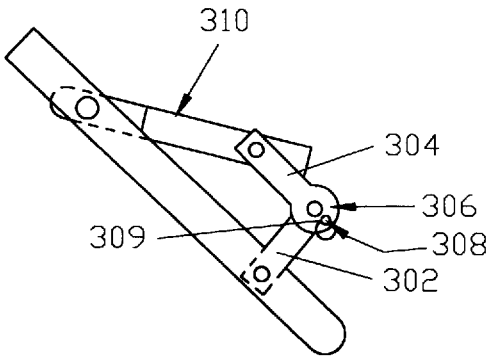

FIG. 8 illustrates another embodiment, a seat 300 which has many of the structural elements of the seat 250 shown in FIG. 5. The seat 300 differs in that cranks 302 are mounted to prop posts 304 with lockable pivotable connectors 306. The lockable pivotable connectors 306 employ a locking pin 308 which slidably engages an outer locking pin passage 309, and can be set into one of two inner locking pin recesses (not shown), allowing the lockable pivots 306 to rotate between an upper position, shown in side view in FIG. 9, and a lower position, shown in side view in FIG. 10, to provide for two positions for the platform 310. It should be appreciated that other locking means could be employed by the lockable pivotable connectors 306 to maintain them in the upper and lower positions.

Figure 11:
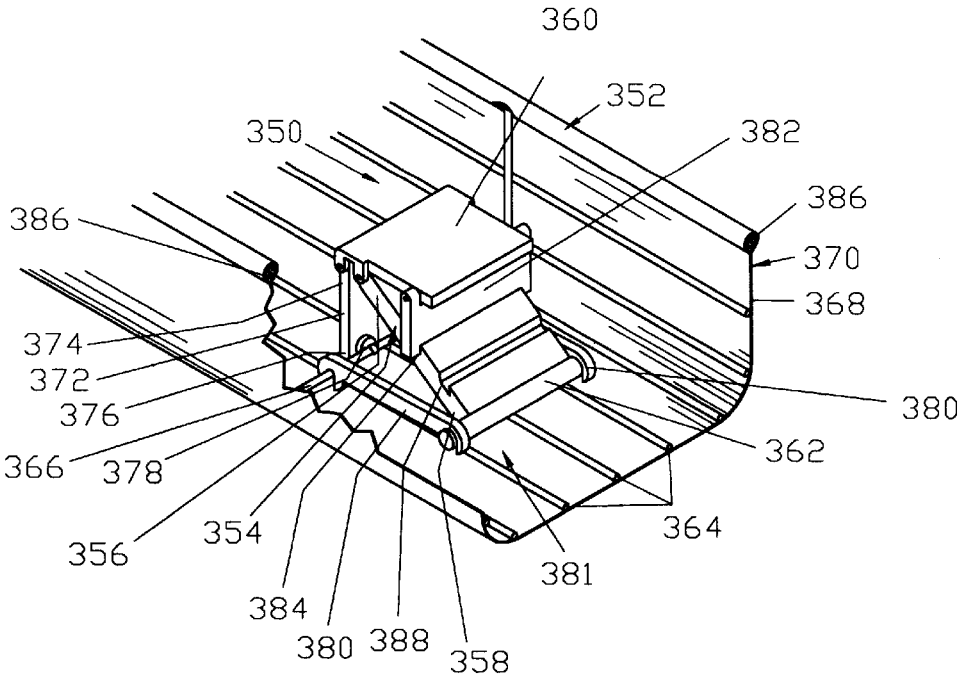
FIG. 11 is an isometric view of an embodiment of the seat of the present invention designed for use in a collapsible canoe. The seat has a brace which is pivotably attached to a platform. The brace terminates in a cross support, which is an integral part of the brace. A prop is pivotably attached to the platform and engages a first brace slot in the brace. A second brace slot is also provided on the brace, and the engagement of the prop with the brace slots serves to maintain the platform in either a substantially horizontal position or in an inclined position with respect to the gunwales. A brace support is pivotably attached to the platform, and a pair of retaining elements are attached to a rib of the collapsible canoe and to the cross support. The retaining element, cross support, and rib form a base with the brace affixed thereto and the brace support being connected to the rib.

FIG. 11 shows another embodiment of the present invention, a seat 350. The seat 350 is designed to be used in a collapsible canoe 352. The seat 350 has a brace 354, having a brace first end region 356 and a brace second end region 358. A platform 360 is pivotably attached the brace first end region 356.

A cross support 362 is attached to the brace second end region 358 and is an integral part thereof. The cross support 362 rests upon stringers 364, which are supported by ribs 366. The stringers 364, in combination with a skin 368, form a canoe shell 370. The cross support 362 serves to distribute the load from the second brace end region 358 and prevents the skin 368 from being damaged by the brace 354.

A brace support 372 is provided which connects the brace first end region 356 to the collapsible canoe 352. The brace support 372 has a brace support first end region 374 and a brace support second end region 376. The brace support first end region 374 is pivotably attached to the platform 360, allowing the brace support 372 to pivot with respect to the brace 354. A brace support clamp 378 is attached to the brace support second end region 376 and is configured to be engageable with one of the ribs 366 of the collapsible canoe 352, and, when so engaged, connects the brace first end region 356 to the collapsible canoe 352.

A pair of retaining elements 380 are provided, which engage one of the ribs 366 and the cross support 362 to maintain a fixed separation therebetween. In combination, the retaining elements 380, the rib 366, and the cross support 362 form a base 381 to which the brace 354 and brace support 372 are connected.

A prop 382 is pivotably mounted with respect to the platform 360 and can be rotated to engage a first brace slot 384 provided in the brace 354, which will maintain the platform 360 in a position which is substantially parallel to gunwales 386 of the collapsible canoe 352. A second brace slot 388 is also provided in the brace 354, positioned such that when it is engaged by the prop 382, the platform 360 will be inclined with respect to the gunwales 386.

Figure 12:
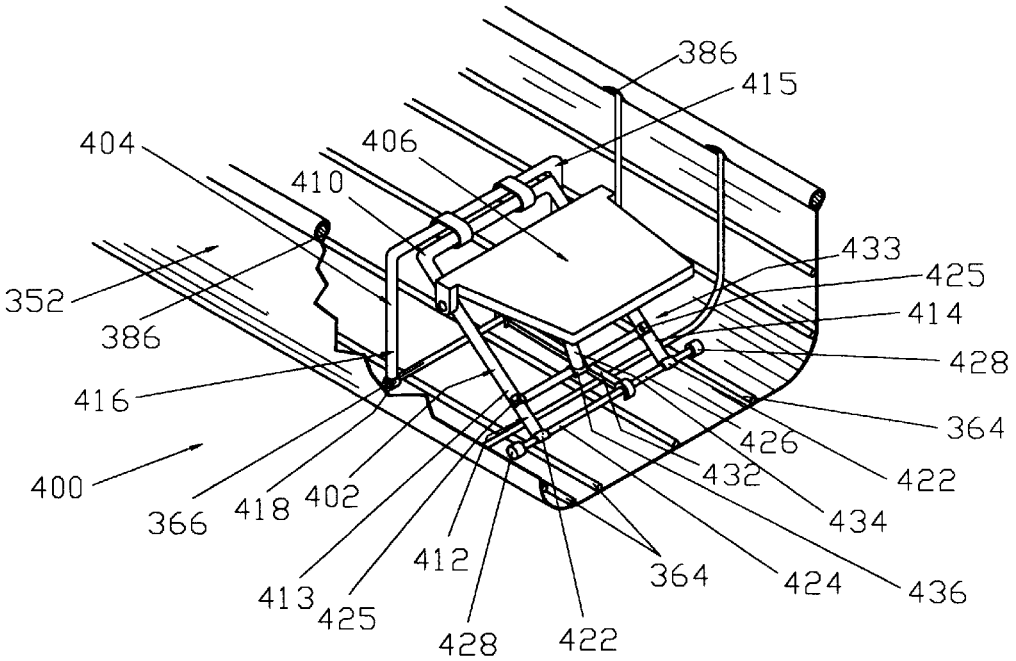
FIG. 12 is an isometric view of another embodiment of the seat of the present invention which is similar to the embodiment of FIG. 11. The seat of FIG. 12 differs in that the brace, the brace support, and the prop are fabricated from tube stock. The cross support is a separate member and is engaged with brace clamps which are attached to the brace.

FIG. 12 is an isometric view of another embodiment of the present invention, a seat 400 which is particularly well suited for use in a collapsible canoe, since it has a brace 402 and a brace support 404 which are fabricated from tubular stock to provide a light weight structure. A platform 406 is pivotably attached to the brace 402, and allows the seat 400 to be readily collapsed, providing a light weight, compact structure for storage and transport with a collapsible canoe. The brace 402 has a U-shape configuration. The closed end of the brace 402 provides a brace first end region 410, while the open end of the brace 402 provides a brace second end region 412 and provides a first brace rail 413 and a second brace rail 414.

The brace support 404 also has a U-shape configuration. The closed end of the brace support 404 provides a brace support first end region 415, and the open end of the brace support 404 provides a brace support second end region 416. The brace support first end region 415 is pivotably attached to the brace first end region 410 of the brace 402, while the brace support second end region 416 is fitted with brace support clamps 418 (only one of which is shown in FIG. 12) which engage one of the ribs 366 of the collapsible canoe 352.

The platform 406 is pivotably attached to the first brace end region 410, and brace clamps 422 are attached to the first brace rail 413 and the second brace rail 414 at the second brace end region 412. A first rung 424 connects to the first brace rail 413 and the second brace rail 414, and is affixed thereto with riveted clamps 425. The brace clamps 422 engage a cross support 426, which is also a tubular member and serves as a second rung. The cross support 426 terminates in end caps 428, which serve as stops positioned to sideways engage one or more of the stringers 364 of the collapsible canoe 352, thereby increasing the lateral stability of the seat 400.

A retaining element 432 is provided, which engages the rib 366 and the cross support 426 to maintain a fixed separation between the rib 366 and the cross support 426. Again, the retaining element 432, rib 366, and cross support 426, in combination, form a base 433 to which the brace 402 and brace support 404 are connected.

A prop 434, also fabricated of tubular stock, is pivotably attached to the platform 406. The prop 434 terminates in a prop clamp 436. When the platform 406 is substantially parallel to the gunwales 386, the prop clamp 436 is engaged to the first rung 424, and when the platform 406 is inclined with respect to the gunwales 386, the prop clamp 436 is engaged to the cross support 426 which serves as the second rung.

Figure 13:
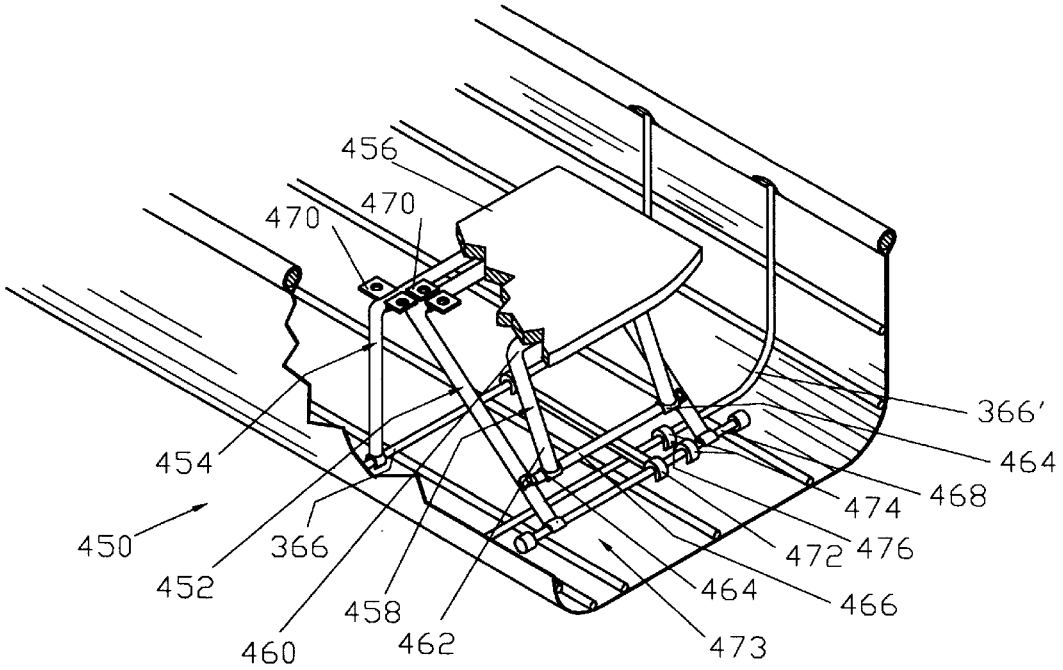
FIG. 13 is an isometric view of another embodiment of the seat of the present invention which is similar to the embodiment of FIG. 12. The brace, the brace support, and the prop are all U-shaped elements, and are configured to nest in each other when the seat is collapsed.

FIG. 13 is an isometric view of another embodiment of the present invention, a seat 450. The seat 450 has a brace 452 and a brace support 454 which have the same structure as the brace 402 and the brace support 404 of the seat 400 illustrated in FIG. 12. The seat 450 differs from the seat 400 in two aspects. The brace support 454 is pivotably engaged to a platform 456 rather than directly pivotably engaging the brace 452, and the seat 450 has a prop 458 which differs from the prop 434 of the seat 400 of FIG. 12.

In the embodiment shown in FIG. 13, the prop 458 is fabricated from tubular stock, and has a U-shape configuration. The U-shape provides a closed end of the prop 458, which provides a prop first end region 460, and an open end of the prop 458, which provides a prop second end region 462. The prop second end region 462 terminates in a pair of prop clamps 464. The prop first end region 460 is pivotably connected to the platform 456 and can be rotated to swing the prop second end region 462 between an upper prop engaging site, where the prop clamps 464 engage a first rung 466 which spans the brace 452, and a lower prop engaging site, where the prop clamps 464 engage a cross support 468, which serves as a second rung. Pairs of seat brackets 470 are attached to the platform 456 and serve to pivotably connect the brace 452, the brace support 454, and the prop 458 to the platform 456.

Again, as with the embodiment shown in FIG. 12, a retaining element 472 is provided which engages a rib 366 and the cross support 468, forming a base 473 to which the brace 452 and brace support 454 are connected. A pair of hold down clips 474 engage a rib 366' and the cross support 468. A spring 476 is connected between the two hold down clips 474. The hold down clips 474 and the spring 476 serve the same function as the elastic strap 180 of the embodiment illustrated in FIG. 4.

Figure 14:
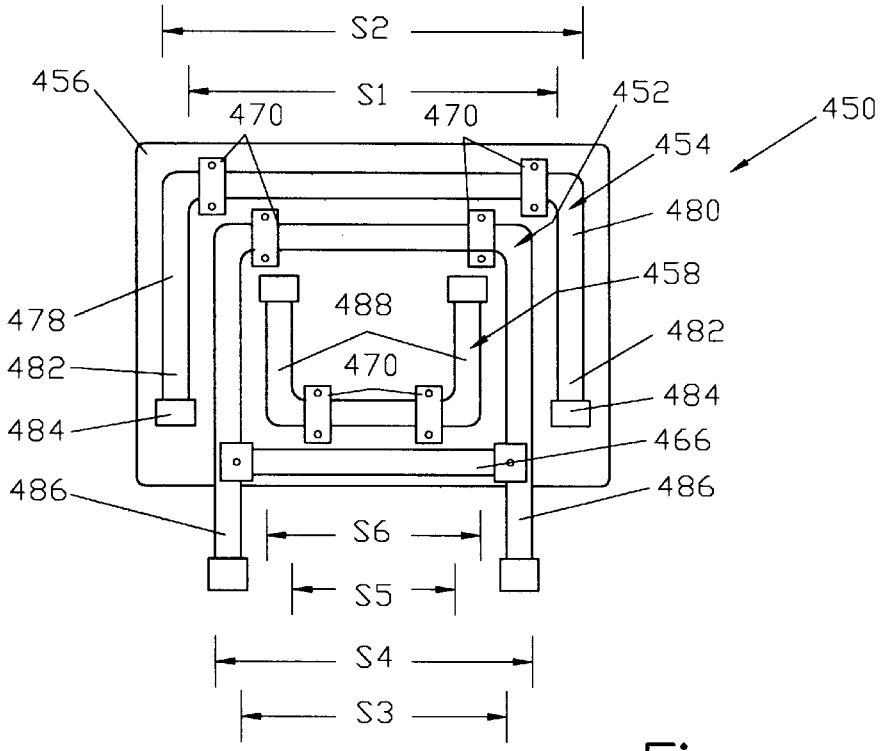
FIG. 14 is a bottom view of the seat illustrated in FIG. 13, shown in the collapsed configuration to illustrate the nested brace support, brace, and prop.

FIG. 14 is a bottom view of the seat 450 when it has been collapsed for storage. FIG. 14 shows the nesting of the brace 452, the brace support 454, and the prop 458. The retaining element 472 and the cross support 468 are not shown in FIG. 14.

A first brace support post 478 and a second brace support post 480 are spaced apart at an inner separation S1, which is defined as the minimum separation between the first brace support post 478 and the second brace support post 480, and at an outer separation S2, which is defined as the maximum separation between the first brace support post 478 and the second brace support post 480. The brace support posts (478, 480) have free ends 482 which terminate in brace support clamps 484 designed to be engaged to a rib of the canoe or, alternatively, to the cross support 468. To minimize lateral slippage between the brace support 454 and the platform 456, it is preferred that the separation between the pair of seat brackets 470 which connect the brace support 454 to the platform 456 be maximized, placing the seat brackets 470 in close proximity to the brace support posts (478 and 480).

Brace rails 486 of the U-shaped brace 452 are spaced apart having an inner separation S3 and an outer separation S4, where the inner separation and the outer separation refer respectively to the minimum and the maximum separation between the brace rails 486. It is preferred that the pair of seat brackets 470 which connect the brace 452 to the platform 456 be positioned in close proximity to the brace rails 486.

Prop posts 488 of the U-shaped prop 458 are spaced apart having an inner separation S5 and an outer separation S6, where again the separation respectively refers to the minimum and the maximum separation between the prop posts 480. It is preferred that the pair of seat brackets 470 which connect the prop 458 to the platform 456 be positioned in close proximity to the prop posts 488.

It is further preferred that the U-shaped brace support 454, brace 452, and prop 458 have their dimensions adjusted such that S6<S3 and S4<S1, to assure that the elements will nest. When the first rung 466 is attached to the brace rails 478 to increase the stability of the brace 452, the spacing of the first rung 466 from the point of attachment of the brace 452 to the platform 456 should be sufficient to accommodate the prop posts 480 when nested.

Figure 15:
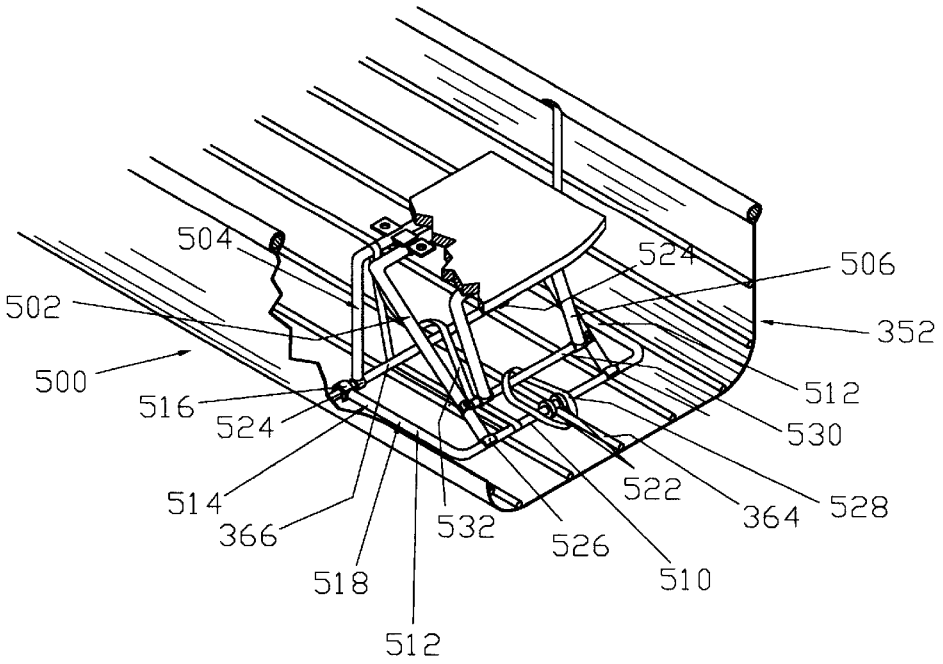
FIG. 15 is an isometric view of another embodiment of the seat of the present invention which is similar to the embodiment of FIG. 13, differing in that the cross support has two integral retaining elements, which pivotably engage a rib of the canoe, and, together with the rib, form a base to which the brace and the brace support are connected. The brace support has brace support clamps, which engage the rib of the canoe, while the brace has brace clamps, which engage the cross support.

FIG. 15 is an isometric view of yet another embodiment of the present invention, a seat 500. The seat 500 has a brace 502, which is similar to the brace 452 of the seat 450; a brace support 504, which is similar to the brace support 454 of the seat 450; and a prop 506, which is similar to the prop 458 of the seat 450. The seat 500 differs in that it has a cross support 510 which is integrated with a pair of retaining elements 512, forming a U-shaped integrated cross support/retaining element 514. The integrated cross support/retaining element 514 terminates in a pair of retaining element clamps 516 (only one of which is shown) which engage one of the ribs 366 of the collapsible canoe 352. The cross support/retaining element 514 and rib 366 in combination form a base 518 to which the brace 502 and brace support 504 are connected. A pair of stringer-engaging stops 522 are attached to the cross support 510 and sideways engage a stringer 364 of the collapsible canoe 352 to further stabilize the seat 500. The brace support 504 is connected to the rib 366 by brace support clamps 524, and the brace 502 is connected to the cross support 510 with brace clamps 526.

A first tie down 528 is provided which passes around a first rung 530, which is attached to the brace 502, and around the stringer 364 to secure the brace 502 with respect to the collapsible canoe 352.

A second tie down 532 is preferably provided to further stabilize the seat 500 and increase the rigidity of the brace 502 with respect to the brace support 504. As shown in FIG. 15, the second tie-down 532 passes around the brace support 504, the stringer 364, the cross support 510, and the rib 366.

Figure 16:
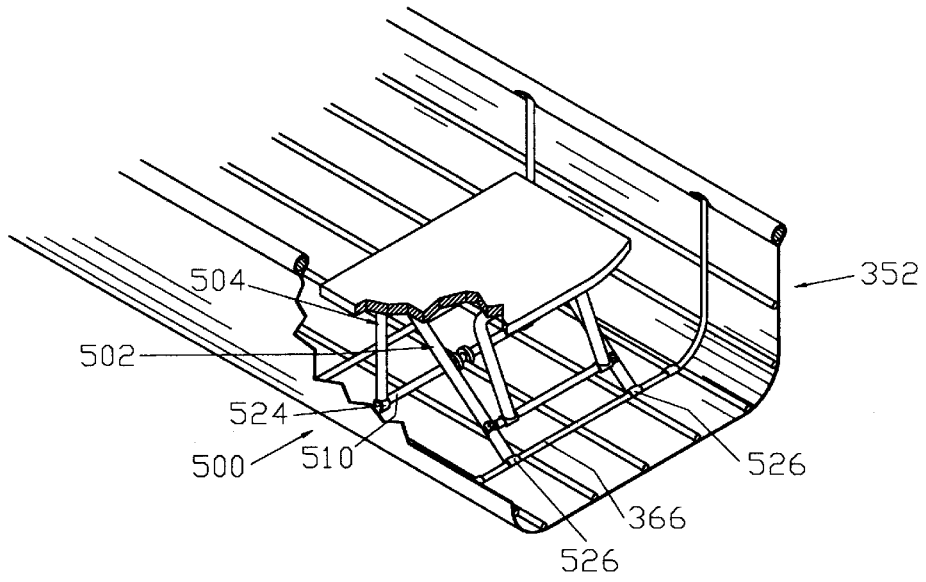
FIG. 16 illustrates the same seat as is illustrated in FIG. 15. In this illustration, the connection of the brace and the brace support to the base has been reversed. As shown, the brace clamps engage the rib and the brace support clamps engage the cross support.

FIG. 16 illustrates the seat 500, where it has been installed in the collapsible canoe 352 with an alternate attachment arrangement. In FIG. 16, the seat 500 is installed with the brace support clamps 524 attached to the cross support 510, and the brace clamps 526 attached to the rib 366. The alternative attachment arrangements of the seat 500 allow for greater variability in the bow to aft position of the seat 500.

While the invention has been described in terms of preferred embodiments, it should be appreciated that variations are possible without departing from the spirit of the invention.

What I claim is:

1. A canoe seat for a canoe having gunwales stabilized by thwarts, the canoe having a shell with a beam B, the canoe seat comprising:

a brace having a brace first end region, which is connected to the boat, and a brace second end region, which is supported on the shell of the boat;

a connector attached to said brace first end region and to one of the thwarts, said connector providing a pivotable connection of said brace first end region to one of the thwarts of the canoe;

a platform which is pivotably mounted with respect to said brace for support of the operator, said platform having a width W which is less than the beam B of the shell; and means for maintaining said platform in a substantially horizontal position for supporting the operator, where said platform is substantially parallel to the gunwales, and an inclined position for supporting the operator, where said platform is inclined with respect to the gunwales.

2. The canoe seat of claim 1 wherein said means for maintaining said platform in said substantially horizontal position and said inclined position further comprises:

a prop having a prop first end region and a prop second end region, said prop being rotatable between an upper prop position, where said prop engages said platform and said brace such that said platform will be substantially parallel to the gunwales, and a lower prop position, where said prop engages said platform and said brace such that said platform will be inclined with respect to the gunwales.

3. The canoe seat of claim 2 wherein when said prop first end region is pivotably attached to said platform and said prop second end region rotates between an upper prop engaging site associated with said brace and a lower prop engaging site associated with said brace, said upper prop engaging site being so positioned that when said prop second end region is engaged with said upper prop engaging site, said platform is substantially parallel to the gunwales; and said lower prop engaging site being so positioned that when said lower prop end region is engaged with said prop second engaging site, said platform is inclined with respect to the gunwales.

4. The canoe seat of claim 3 wherein said brace further comprises:

a first brace rail having a first brace rail first end region, which forms part of said brace first end region, and a first brace rail second end region, which forms part of said brace second end region;

a second brace rail having a second brace rail first end region, which forms part of said brace first end region, and a second brace rail second end region, which forms part of said brace second end region, said second brace rail being spaced apart from said first brace rail; and means for maintaining said first brace rail spaced apart from said second brace rail.

5. The canoe seat of claim 4 wherein said means for maintaining said first brace rail spaced apart from said second brace rail further comprises:

a first rung which engages said first brace rail and said second brace rail, said first rung being positioned in said brace second end region; and a second rung spaced apart from said first rung, said second rung engaging said first brace rail and said second brace rail, said second rung being positioned in said brace second end region such that said first rung lies between said second rung and said brace first end region.

6. The canoe seat of claim 5 wherein said first rung serves as said upper prop engaging site and said second rung serves as said lower prop engaging site and further wherein said prop further comprises:

a first prop post having:

a first prop post first end providing part of said prop first end region, said first prop post first end being pivotably attached to said platform; and a first prop post second end terminating in a first prop clamp, said first prop post second end and said first prop clamp providing part of said prop second end region, said first prop clamp being configured to be engageable with said first rung and said second rung; and a second prop post having:

a second prop post first end providing part of said prop first end region, said second prop post first end being pivotably attached to said platform; and a second prop post second end terminating in a second prop clamp, said second prop post second end and said second prop clamp providing part of said prop second end region, said second prop clamp being configured to be engageable with said first rung and said second rung.

7. The canoe seat of claim 6 further comprising:

an expandable coupling connecting said brace second end region to the canoe.

8. The canoe seat of claim 5 wherein:

a first rail upper engaging site on said first brace rail and a second rail upper engaging site on said second brace rail provide said upper prop engaging site; and a first rail lower engaging site on said first brace rail and a second rail lower engaging site on said second brace rail provide said lower prop engaging site; and further wherein said prop further comprises:

a first prop post having a first prop post first end which is pivotably attached to said platform and a first prop post second end contoured to engage said first brace rail; and a second prop post having a second prop post first end which is pivotably attached to said platform and a second prop post second end contoured to engage said second brace rail; and still further wherein said means for maintaining said platform in a substantially horizontal position and an inclined position further comprises:

a first crank pivotably engaging said first prop post second end and said first brace rail, said first crank directing said first prop post second end between said first rail upper engaging site and said first rail lower engaging site; and a second crank pivotably engaging said second prop post second end and said second brace rail, said second crank directing said second prop post second end between said second rail upper engaging site and said second rail lower engaging site.

9. The canoe seat of claim 1 wherein said means for maintaining said platform in said substantially horizontal position and said inclined position further comprises:

a prop having a first prop post and a second prop post, said first prop post having a first prop post first end and a first prop post second end, said first prop post first end being pivotably attached to said platform, and said second prop post having a second prop post first end and a second prop post second end, said second prop post first end being pivotably attached to said platform;

a first crank pivotably connected to said brace;

a first lockable pivotable connector connecting said first prop post second end with said first crank, said first lockable pivotable connector having a first pivotable connector upper locking position and a first pivotable connector lower locking position, wherein when said first lockable pivotable connector is locked in said first pivotable connector upper locking position, said platform is in said substantially horizontal position, and when said first lockable pivotable connector is locked in said first pivotable connector lower locking position, said platform is in said inclined position;

a second crank pivotably connecting to said brace; and a second lockable pivotable connector connecting said second prop post second end with said second crank, said second lockable pivotable connector having a second pivotable connector upper locking position and a second pivotable connector lower locking position, wherein when said second lockable pivotable connector is locked in said second pivotable connector upper locking position, said platform is in said substantially horizontal position, and when said second lockable pivotable connector is locked in said second pivotable connector lower locking position, said platform is in said inclined position.

10. A collapsible canoe seat suitable for use in a collapsible canoe having a shell, the shell having a flexible skin supported by stringers, which in turn are supported by ribs which are tied into gunwales stabilized by thwarts, the collapsible canoe seat comprising:

a brace having a brace first end region and a brace second end region;

a platform pivotably mounted with respect to said brace;

a brace support having a brace support first end region and a brace support second end region, said brace support first end region being pivotably mounted with respect to said brace;

a prop having a prop first end region and a prop second end region, said prop being rotatable between an upper prop position, where said prop engages said platform and said brace such that said platform will be substantially parallel to the gunwales, and a lower prop position, where said prop engages said platform and said brace such that said platform will be inclined with respect to the gunwales;

a cross support which traverses the stringers;

a retaining element which attaches to one of the ribs and to said cross support, said retaining element, said one of the ribs, and said cross support in combination providing a base;

means for connecting said brace and said brace support to said base.

11. The collapsible canoe seat of claim 10 wherein said prop first end region is pivotably attached to said platform and said prop second end region rotates between an upper prop engaging site associated with said brace and a lower prop engaging site associated with said brace, said upper prop engaging site being so positioned that when said prop second end region is engaged with said upper prop engaging site, said prop is in said upper prop position, thereby maintaining said platform substantially parallel to the gunwales; and said lower prop engaging site being so positioned that when said prop second end region is engaged with said lower prop engaging site, said prop is in said lower prop position, thereby maintaining said platform inclined with respect to the gunwales.

12. The collapsible canoe seat of claim 11 wherein said brace further comprises:

a first brace rail;

a second brace rail spaced apart from said first brace rail; and means for maintaining said second brace rail spaced apart from said first brace rail.

13. The collapsible canoe seat of claim 12 wherein said brace, said brace support and said prop are configured such that they nest when the collapsible canoe seat is collapsed.

14. The collapsible canoe seat of claim 13 wherein:

said brace has a U-shape configuration, having an open end region of said brace and a closed end of said brace, said closed end of said brace providing said brace first end region and said open end region of said brace providing said brace second end region, said first brace rail, and said second brace rail;

further wherein said brace support has a U-shaped configuration, having an open end region of said brace support and a closed end of said brace support, said closed end of said brace support providing said brace support first end region and said open end region of said brace support providing said brace support second end region, a first brace support post, and a second brace support post;

still further wherein said prop has a U-shaped configuration, having an open end region of said prop and a closed end of said prop, said closed end of said prop providing said prop first end region and said open end region of said prop providing said prop second end region, a first prop post, and a second prop post; and yet further wherein said means for maintaining said second brace rail spaced apart from said first brace rail further comprises:

a first rung fixably engaged with said first brace rail and said second brace rail, said first rung being positioned to accommodate said nesting of said brace, said brace support, and said prop.

15. The collapsible canoe seat of claim 14 wherein said brace, said brace support, said prop, said first rung, said cross support, and said retaining element are formed from tubular stock.

16. The collapsible canoe seat of claim 15 wherein said cross support and said retaining element are an integrated unit, forming a U-shaped configuration terminating in retaining element clamps configured to engage a rib of the canoe.

17. The collapsible canoe seat of claim 15 wherein said means for connecting said brace and said brace support to said base further comprises:

brace support clamps which terminate said first and second brace support posts, said brace support clamps being configured to engage the ribs of the canoe and said cross support; and brace clamps which terminate said first and second brace rails, said brace clamps being configured to engage the ribs of the canoe and said cross support.

18. The collapsible canoe seat of claim 16 wherein said means for connecting said brace and said brace support to said base further comprises:

brace support clamps which terminate said first and second brace support posts, said brace support clamps being configured to engage the ribs of the canoe and said cross support; and brace clamps which terminate said first and second brace rails, said brace clamps being configured to engage the ribs of the canoe and said cross support.

19. The collapsible canoe seat of claim 17 wherein said first rung serves as said upper prop engaging site and said cross support serves as said lower prop engaging site.

20. The collapsible canoe seat of claim 18 wherein said first rung serves as said upper prop engaging site and said cross support serves as said lower prop engaging site.

21. The collapsible canoe seat of claim 10 further comprising:

an adjustable connector connecting said brace second end region with the shell of the collapsible canoe.

22. The collapsible canoe seat of claim 10 further wherein said brace and said brace support are pivotably attached to said platform.

23. The collapsible canoe seat of claim 10 further comprising:

a stringer-engaging stop attached to said cross support and positioned so as to engage one of the stringers.

24. A collapsible canoe seat suitable for use in a collapsible canoe having a shell, the shell having a flexible skin supported by stringers which in turn are supported by ribs which are tied into gunwales stabilized by thwarts, the collapsible canoe seat comprising:

a brace having a brace first end region and a brace second end region;

means for supporting said brace second end region on the shell of the collapsible canoe;

a platform pivotably mounted with respect to said brace;

a brace support having a brace support first end region and a brace support second end region, said brace support first end region being pivotably mounted with respect to said brace;

means for connecting said brace support second end region to one of the ribs;

a prop having a prop first end region and a prop second end region, said prop being rotatable between an upper prop position, where said prop engages said platform and said brace such that said platform will be substantially parallel to the gunwales, and a lower prop position where said prop engages said platform and said brace such that said platform will be inclined with respect to the gunwales;

a cross support which traverses the stringers;

a retaining element which attaches to one of the ribs and to said cross support, thereby connecting said cross support to one of the ribs.

25. The collapsible canoe seat of claim 24 wherein said prop first end region is pivotably attached to said platform and said prop second end region rotates between an upper prop engaging site associated with said brace and a lower prop engaging site associated with said brace, said upper prop engaging site being so positioned that when said prop second end region is engaged with said upper prop engaging site, said prop is in said upper prop position, thereby maintaining said platform substantially parallel to the gunwales; and said lower prop engaging site being so positioned that when said prop second end region is engaged with said lower prop engaging site, said prop is in said lower prop position, thereby maintaining said platform inclined with respect to the gunwales.

26. The collapsible canoe seat of claim 25 wherein said brace further comprises:

a first brace rail;

a second brace rail spaced apart from said first brace rail; and means for maintaining said second brace rail spaced apart from said first brace rail.

27. The collapsible canoe seat of claim 26 wherein said brace, said brace support and said prop are configured such that they nest when the collapsible canoe seat is collapsed.

28. The collapsible canoe seat of claim 27 wherein:

said brace has a U-shape configuration, having an open end region of said brace and a closed end of said brace, said closed end of said brace providing said brace first end region and said open end region of said brace providing said brace second end region, said first brace rail, and said second brace rail;

further wherein said brace support has a U-shaped configuration, having an open end region of said brace support and a closed end of said brace support, said closed end of said brace support providing said brace support first end region and said open end region of said brace support providing said brace support second end region, a first brace support post, and a second brace support post;

still further wherein said prop has a U-shaped configuration, having an open end region of said prop and a closed end of said prop, said closed end of said prop providing said prop first end region and said open end region of said prop providing said prop second end region, a first prop post, and a second prop post; and yet further wherein said means for maintaining said second brace rail spaced apart from said first brace rail further comprises:

a first rung fixably engaged with said first brace rail and said second brace rail, said first rung being positioned to accommodate said nesting of said brace, said brace support, and said prop.

29. The collapsible canoe seat of claim 28 wherein said brace, said brace support, said prop, said first rung, said cross support, and said retaining element are formed from tubular stock.

30. The collapsible canoe seat of claim 29 wherein said cross support and said retaining element are an integrated unit, forming a U-shaped configuration terminating in retaining element clamps configured to engage a rib of the canoe.

31. The collapsible canoe seat of claim 29 wherein said means for connecting said brace support second end region to one of the ribs further comprises:

brace support clamps which terminate said first and second brace support posts, said brace support clamps being configured to be engageable with the ribs of the canoe and with said cross support; and further wherein said means for supporting said brace second end region on the shell further comprises:

brace clamps which terminate said first and second brace rails, said brace clamps being configured to be engageable with the ribs of the canoe and with said cross support.

32. The collapsible canoe seat of claim 30 wherein said means for connecting said brace support second end region to one of the ribs further comprises:

brace support clamps which terminate said first and second brace support posts, said brace support clamps being configured to be engageable with the ribs of the canoe and with said cross support; and further wherein said means for supporting said brace second end region on the shell further comprises:

brace clamps which terminate said first and second brace rails, said brace clamps being configured to be engageable with the ribs of the canoe and with said cross support.

33. The collapsible canoe seat of claim 31 wherein said first rung serves as said upper prop engaging site and said cross support serves as said lower prop engaging site.

34. The collapsible canoe seat of claim 32 wherein said first rung serves as said upper prop engaging site and said cross support serves as said lower prop engaging site.

35. The collapsible canoe seat of claim 24 further comprising:

an adjustable connector connecting said brace second end region with the shell of the collapsible canoe.

36. The collapsible canoe seat of claim 24 further wherein said brace and said brace support are pivotably attached to said platform.

37. The collapsible canoe seat of claim 24 further comprising:

a stringer engaging stop attached to said cross support and postioned so as to engage one of the stringers.

* * * * *